US007571707B2

(12) United States Patent
Gibson et al.

(10) Patent No.: US 7,571,707 B2
(45) Date of Patent: Aug. 11, 2009

(54) ENGINE MODE TRANSITION UTILIZING DYNAMIC TORQUE CONTROL

(75) Inventors: Alex O'Connor Gibson, Ann Arbor, MI (US); John Ottavio Michelini, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 95 days.

(21) Appl. No.: 11/788,420

(22) Filed: Apr. 19, 2007

(65) Prior Publication Data

US 2008/0262695 A1 Oct. 23, 2008

(51) Int. Cl.
*F02D 13/06* (2006.01)

(52) U.S. Cl. ..... 123/295; 123/198 F; 123/332; 123/333; 123/334; 123/335; 123/406.41; 123/406.42

(58) Field of Classification Search ..... 123/198 F, 123/295, 334, 335, 332, 333, 406.41, 406.42
See application file for complete search history.

(56) References Cited

U.S. PATENT DOCUMENTS 5,778,856 A * 7/1998 Okada et al. ..... 123/406.47
6,283,089 B1 * 9/2001 Fuwa et al. ..... 123/295
6,302,081 B1 * 10/2001 Moser et al. ..... 123/295
6,497,212 B2 * 12/2002 Matsumoto et al. ..... 123/295
6,502,546 B2 * 1/2003 Kawasaki et al. ..... 123/399
6,546,910 B2 4/2003 Tanaka et al.
6,644,275 B2 * 11/2003 Kondo ..... 123/406.47
6,739,295 B1 5/2004 Yamaoka et al.
6,830,536 B2 * 12/2004 Tanaka et al. ..... 477/110
7,089,912 B2 * 8/2006 Koopmans ..... 123/406.45
2006/0196466 A1 * 9/2006 Kuo et al. ..... 123/295
2007/0131196 A1 6/2007 Gibson et al.

OTHER PUBLICATIONS

Falkowski, A. et al., "Design and Development of the DaimlerChrysler 5.7L HEMI® Engine Multi-Displacement Cylinder Deactivation System", SAE Technical Paper Series No. 2004-01-2106, 2004 SAE International.

* cited by examiner

*Primary Examiner*—Erick Solis
(74) *Attorney, Agent, or Firm*—Allan J. Lippa; Alleman Hall McCoy Russell & Tuttle LLP

(57) ABSTRACT

A method of operating an engine having a plurality of cylinders, the method comprising of transitioning the engine from a first mode to a second mode, and temporarily adjusting an amount of torque produced by a cylinder of the engine for at least one cycle responsive to a difference in an amount of torque produced by a previous firing cylinder and a subsequent firing cylinder.

14 Claims, 12 Drawing Sheets

ENGINE MODE TRANSITION UTILIZING DYNAMIC TORQUE CONTROL

BACKGROUND AND SUMMARY

Some internal combustion engines can vary operation of one or more cylinders between different modes of operation depending on the operating conditions of the engine or other vehicle systems. As one example, at least a portion of the engine cylinders can be transitioned between a spark ignition (SI) mode and a homogeneous charge compression ignition (HCCI) mode in response to the level of torque requested by the vehicle operator. As another example, the number of firing cylinders may be reduced, under some conditions, by the use of cylinder deactivation, in order to conserve fuel and improve efficiency of the engine, while the number of firing cylinders may be increased where a greater amount of engine torque is requested. In this way, advantages associated with each mode of operation can be achieved while reducing or eliminating the disadvantages of each of the modes by selectively utilizing mode transitions.

However, the inventors herein have recognized some issues relating to the above approaches. Specifically, in some conditions, engine transitions between different modes of operation may cause torque transients or discontinuities that can result in increased longitudinal acceleration of the vehicle and/or excitation of the vehicle driveline. As such, the mode transitions may, in some cases, be perceived by the vehicle operator, may increase mechanical wear of vehicle components, or may increase the likelihood of mechanical malfunction, due to the torque transients occurring during the transition.

In at least one approach described herein, at least some of the above issues may be addressed by a method of operating an engine having a plurality of cylinders, the method comprising transitioning the engine from a first mode to a second mode; and temporarily adjusting an amount of torque produced by a cylinder of the engine for at least one cycle responsive to a difference in an amount of torque produced by a previous firing cylinder and a subsequent firing cylinder. In this way, one or more cylinders of the engine may be adjusted before or after the transition responsive to the torque signature of the first mode and the second mode, thereby reducing torque transients that may result in excitation of the driveline including the transmission and/or increased longitudinal acceleration of the vehicle. Note that the different modes of operation may include a change in combustion mode, number of firing cylinders, and/or the number of strokes performed per cycle.

As another approach described herein, at least some of the above issues may be addressed by a method of operating an engine having a plurality of cylinders, wherein the engine is configured to provide torque to a drive wheel of a vehicle via a transmission, the method comprising transitioning the engine from a first mode to a second mode; and adjusting an amount of torque produced by at least one of a last firing event of a cylinder in the first mode and a first firing event of a cylinder in the second mode responsive to a condition of the transmission. In this way, the engine may be controlled during transitions between different modes of operation in response to a condition of the transmission such as the selected gear ratio or the amount of slip provided by a transmission clutch, for example.

As yet another approach described herein, at least some of the above issues may be addressed by a method of operating an engine having a plurality of cylinders, the method comprising transitioning at least one cylinder of the engine from a first mode to a second mode; and temporarily adjusting a peak amount of torque produced by one of a last firing cylinder of the first mode and a first firing cylinder of the second mode for at least one cycle responsive to a difference between a first quantity of firing cylinders in the first mode and a second quantity of firing cylinders in the second mode. In this way, the engine may be controlled during transitions between modes having different quantities of firing cylinders, such as may be provided by a variable displacement engine.

It should be appreciated that the several approaches provided by the above summary are non-limiting examples of the various concepts that will be further described in the detailed description and are not intended to define the scope of the present application or claimed invention.

DETAILED DESCRIPTION

Figure 1:
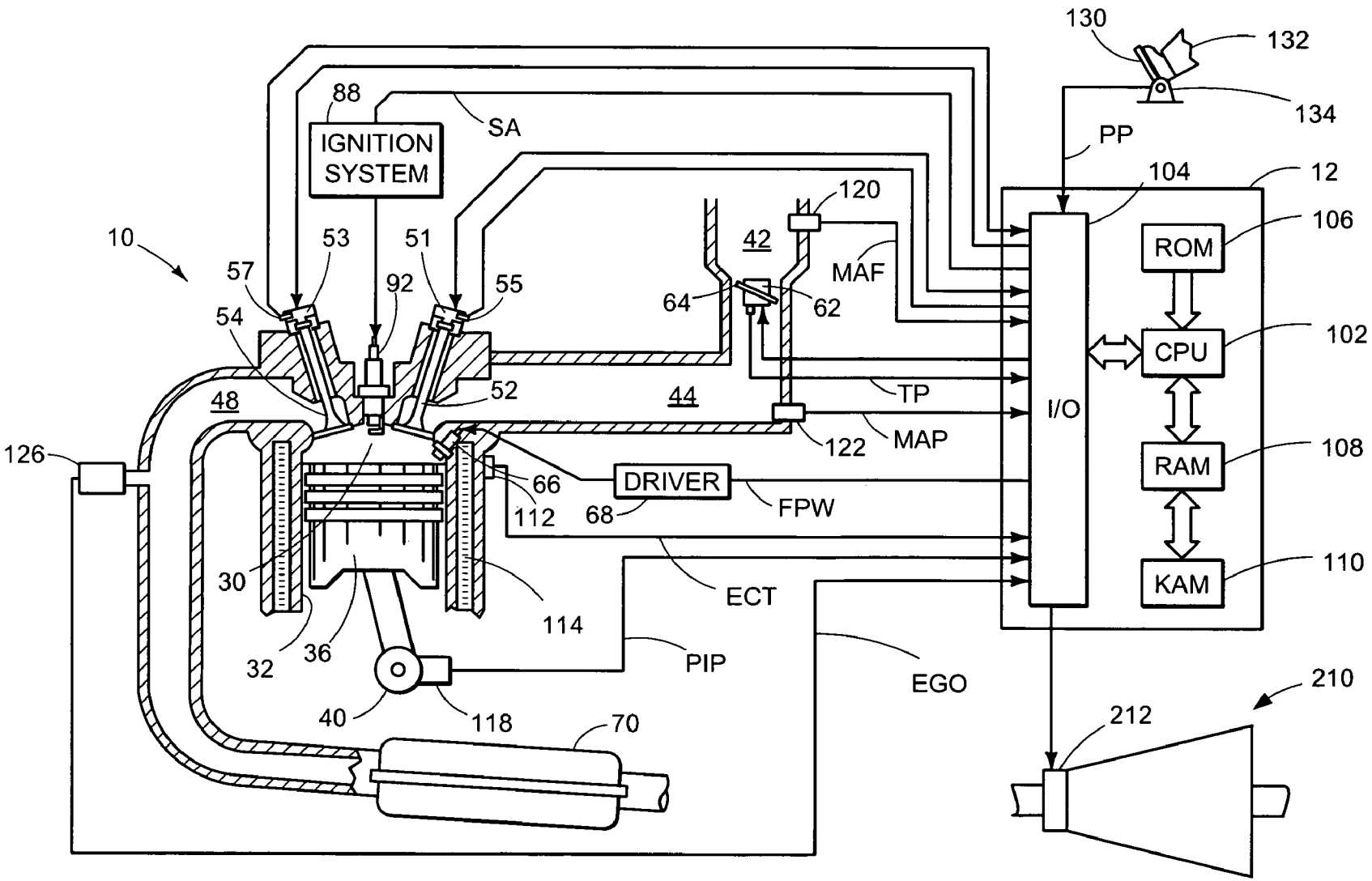
FIGS. 1 and 2 illustrate example engine systems.
Figure 2:
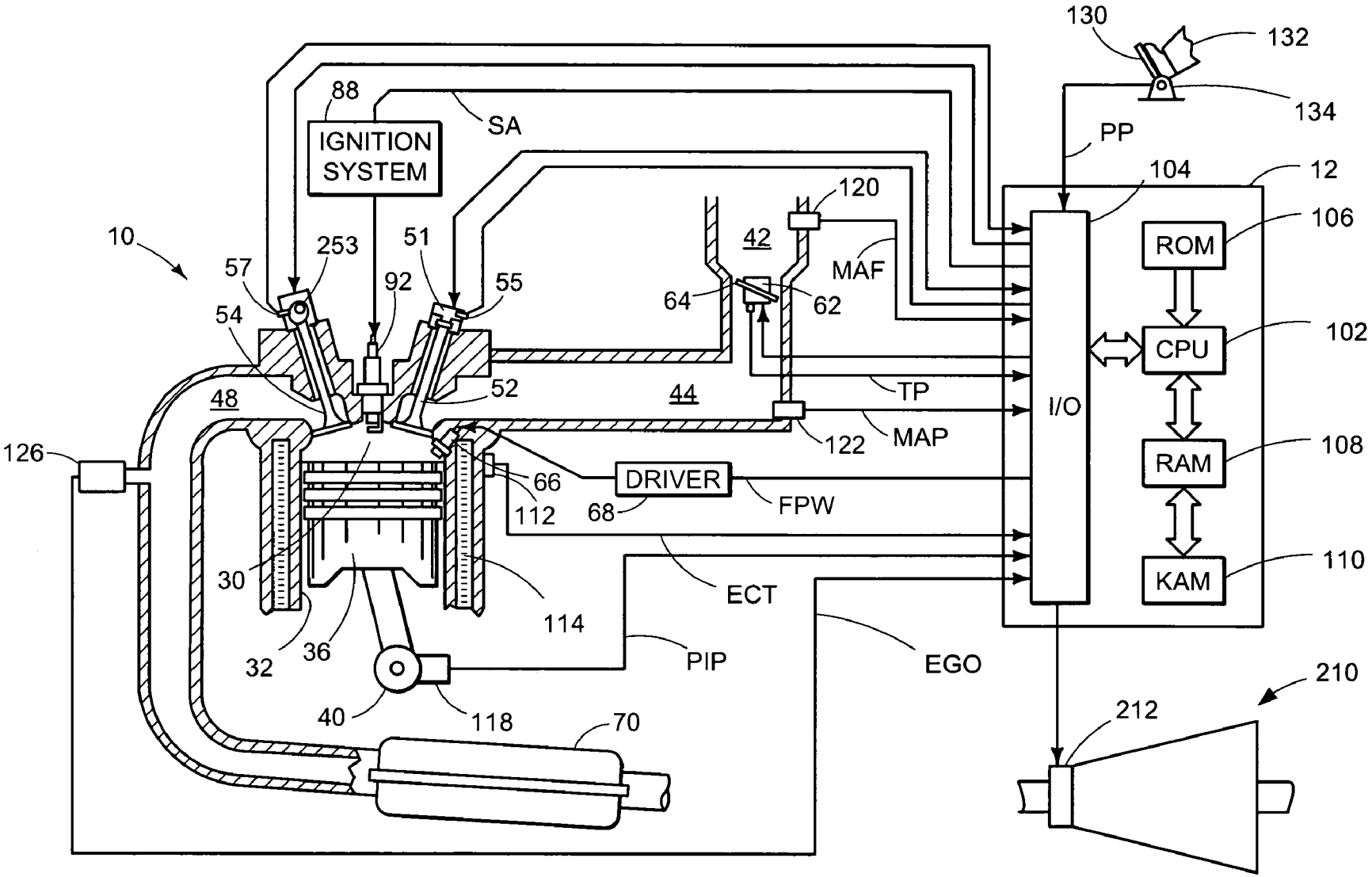

Referring to FIGS. 1 and 2, an example cylinder of multi-cylinder engine 10 is schematically shown. Engine 10 may be included, for example, with a vehicle propulsion system. Engine 10 may be controlled by a control system including controller 12 and by input from a vehicle operator 132 via an input device 130. In this example, input device 130 includes an accelerator pedal and a pedal position sensor 134 for generating a proportional pedal position signal PP. Combustion chamber (i.e. cylinder) 30 of engine 10 may include combustion chamber walls 32 with piston 36 positioned therein. Piston 36 may be coupled to crankshaft 40 so that reciprocating motion of the piston is translated into rotational motion of the crankshaft. Crankshaft 40 may be coupled to at least one drive wheel of the passenger vehicle via a transmission system 210. Further, a starter motor may be coupled to crankshaft 40 via a flywheel to enable a starting operation of engine 10.

Combustion chamber 30 may receive intake air from intake passage 44 via intake manifold 42 and may exhaust combustion gases via exhaust passage 48. Intake passage 44 and exhaust passage 48 can selectively communicate with combustion chamber 30 via respective intake valve 52 and exhaust valve 54. In some embodiments, combustion chamber 30 may include two or more intake valves and/or two or more exhaust valves. The position of intake valve 52 may be controlled by controller 12 via electric valve actuator (EVA) 51. Further, FIG. 1 shows an example where exhaust valve 54 may be controlled by controller 12 via an electric valve actuator (EVA) 53, while FIG. 2 shows an example where exhaust valve 54 may be controlled by a cam actuation system 253. The configuration illustrated in FIG. 2, where the intake valves are controlled by EVA while the exhaust valves are controlled by cam actuation may be referred to as intake valve EVA or iEVA. During some conditions, controller 12 may vary the signals provided to actuators 51 and 53/253 to control the opening and closing of the respective intake and exhaust valves. The position of intake valve 52 and exhaust valve 54 may be determined by valve position sensors 55 and 57, respectively. In embodiments where cam actuation is utilized for at least one valve, for example as shown in FIG. 2, operation of the cam actuated valve may be varied by one or more actuators to provide cam profile switching (CPS), variable cam timing (VCT), variable valve timing (VVT) and/or variable valve lift (VVL). In this way, operation of the valves may be controlled by at least one of EVA or cam actuation to enable operation of the valve to be varied in response to operating conditions of the engine.

Fuel injector 66 is shown coupled directly to combustion chamber 30 for injecting fuel directly therein in proportion to the pulse width of signal FPW received from controller 12 via electronic driver 68. In this manner, fuel injector 66 provides what may be referred to as direct injection (DI) of fuel into combustion chamber 30. The fuel injector may be mounted at other suitable location within the combustion chamber including the side or the top of the combustion chamber, for example. Fuel may be delivered to fuel injector 66 by a fuel system (not shown) including a fuel tank, a fuel pump, and a fuel rail. In some embodiments, combustion chamber 30 may alternatively or additionally include a fuel injector arranged in intake passage 44 in a configuration that provides what may be referred to as port injection (PI) of fuel into the intake port upstream of combustion chamber 30.

Intake manifold 42 may include a throttle 62 having a throttle plate 64. In this particular example, the position of throttle plate 64 may be varied by controller 12 via a signal provided to an electric motor or actuator included with throttle 62, a configuration that may be referred to as electronic throttle control (ETC). Thus, throttle 62 may be operated to vary the intake air provided to combustion chamber 30 among other engine cylinders. The position of throttle plate 64 may be provided to controller 12 by throttle position signal TP. Intake manifold 42 may include a mass air flow sensor 120 and a manifold air pressure sensor 122 for providing respective signals MAF and MAP to controller 12.

Ignition system 88 can provide an ignition spark to combustion chamber 30 via spark plug 92 in response to spark advance signal SA from controller 12, under select operating modes. Though spark ignition components are shown, in some embodiments, combustion chamber 30 or other combustion chambers of engine 10 may be operated in an alternative modes including what may be referred to as compression ignition, which may not necessarily include the use of an ignition spark to initiate combustion.

Exhaust gas sensor 126 may be coupled to exhaust passage 48 upstream of emission control device 70. Sensor 126 may be other suitable sensor for providing an indication of exhaust gas air/fuel ratio such as a linear oxygen sensor or UEGO (universal or wide-range exhaust gas oxygen), a two-state oxygen sensor or EGO, a HEGO (heated EGO), a NOx, HC, or CO sensor. An emission control device 70 can be arranged along exhaust passage 48 downstream of exhaust gas sensor 126. Device 70 may include a three way catalyst (TWC), NOx trap, particulate filter, etc. In some conditions, emission control device 70 may be periodically reset by operating one or more cylinders of the engine at a particular air/fuel ratio.

Controller 12 is shown in FIG. 1 as a microcomputer, including microprocessor unit 102, input/output ports 104, an electronic storage medium for executable programs and calibration values shown as read only memory chip 106 in this particular example, random access memory 108, keep alive memory 110, and a data bus. Controller 12 may receive various signals from sensors coupled to engine 10, in addition to those signals previously discussed, including measurement of inducted mass air flow (MAF) from mass air flow sensor 120; engine coolant temperature (ECT) from temperature sensor 112 coupled to cooling sleeve 114; a profile ignition pickup signal (PIP) from Hall effect sensor 118 (or other type) coupled to crankshaft 40; throttle position (TP) from a throttle position sensor; and absolute manifold pressure signal, MAP, from sensor 122. Engine speed signal, RPM, may be generated by controller 12 from signal PIP. Manifold pressure signal MAP from a manifold pressure sensor may be used to provide an indication of vacuum, or pressure, in the intake manifold. Note that various combinations of the above sensors may be used, such as a MAF sensor without a MAP sensor, or vice versa. During stoichiometric operation, the MAP sensor can give an indication of engine torque. Further, this sensor, along with the detected engine speed, can provide an estimate of charge (including air) inducted into the cylinder. In one example, sensor 118, which is also used as an engine speed sensor, may produce a predetermined number of equally spaced pulses every revolution of the crankshaft. Controller 12 may be communicatively coupled to transmission 210 to enable controller 12 to vary a gear ratio of transmission 210 and/or operation of one or more clutches 212. As one example, controller 12 can control a transmission clutch to increase or decrease the mechanical slip between the input shaft and output shaft of the transmission. In this way, more or less torque may be transmitted to the drive wheel of the vehicle via the drive line. For example, clutch 212 may be controlled to increase slip, under some conditions, in order to reduce longitudinal acceleration, torque transients and/or excitation of the vehicle driveline that may be caused by engine transitions.

As described above, FIGS. 1 and 2 show only one example cylinder of a multi-cylinder engine, and that each of the other engine cylinders may similarly include their own set of intake and exhaust valves, fuel injector, spark plug, etc. Note that an engine may include other suitable number of cylinders including, for example, four, six, eight, or ten cylinder engines.

In some conditions, one or more cylinders of engine 10 may be controlled to vary operation between different modes based on the operating conditions of the engine. As one example, a cylinder of the engine may be transitioned between two or more different combustion modes, which may include spark ignition (SI) of a homogeneous lean charge, spark ignition of a stratified lean charge, spark ignition of a substantially stoichiometric charge, compression ignition including homogeneous charge compression ignition (HCCI) or premixed charge compression ignition (PCCI), multi-stroke modes (e.g. 2 stroke, 4 stroke, 6 stroke, or more strokes), deactivation or disabled modes (e.g. where combustion is discontinued for one or more cycles), or other suitable combustion modes. These different combustion modes may be used to achieve improved performance under a variety of engine operating conditions. For example, efficiency and/or combustion stability may be improved while emissions, misfire, and/or noise and vibration harshness (NVH) may be reduced.

Spark ignition, for example, may be used to achieve stable combustion at substantially low or high engine load or speed conditions due to the use of an ignition spark for the initiation of combustion with the cylinder. Spark ignition of a homogeneous lean charge as described herein may include combustion of a substantially homogeneous mixture of air and fuel via a sparking device, whereby the mixture includes less than a stoichiometric amount of fuel compared to air. Spark ignition of a stratified lean charge as described herein may include combustion of a stratified mixture including less than a stoichiometric amount of fuel compared to air via a sparking device. Spark ignition of a stoichiometric mixture of air and fuel as described herein may include combustion of a mixture including approximately a stoichiometric amount of fuel compared to air, where ignition of the mixture is initiated by a sparking device.

While spark ignition may be used to achieve reliable combustion, the efficiency and/or emission quality may be reduced, in some conditions, as compared to other operating modes such as HCCI. HCCI as described herein may include combustion of a substantially homogeneous mixture of air and fuel and may include less than a stoichiometric amount of fuel compared to air, whereby ignition of the mixture is initiated via autoignition without necessarily requiring a sparking device. Instead, autoignition may be initiated by compression performed by the piston without necessarily requiring an ignition spark to be performed by the sparking device. However, in some conditions, an ignition spark may be used to assist compressed air and fuel mixture to reach autoignition.

In an engine with electronic valve actuation, EVA or iEVA, it is also possible to operate each cylinder in one of a firing or a non-firing state via cylinder deactivation. Cylinder deactivation as described herein may include the operation of discontinuing combustion within the cylinder for one or more cycles. Deactivation of the cylinder may include discontinuing the fuel delivery and/or sparking operation within the cylinder during select conditions. For example, deactivation of one or more cylinders may be used where the level of requested torque is relatively low. In this way, fuel efficiency may be increased, under some conditions, where less than a threshold level of torque is requested by deactivating one or more cylinders of the engine.

A multi-stroke mode as described herein may include operating one or more cylinders of the engine between a first cycle having a first number of strokes and a second cycle having a second different number of strokes, based on operating conditions of the engine. Alternatively or in addition, a multi-stroke mode may include operation of a first portion of cylinders with a cycle having a first number of strokes and a second portion of cylinders with a cycle having a second different number of strokes. For example, a first bank of cylinders may operate with a four-stroke cycle while a second bank of cylinders may operate with a six-stroke cycle and/or may vary operation between the four-stroke and six stroke cycles.

Still other combustion modes are possible. As one example, one or more cylinders of the engine may operate in a diesel cycle mode whereby fuel is injected into a compressed air charge to initiate combustion.

In some conditions, a first portion of the engine cylinders may be operated in one of the above described combustion modes while a second portion of the cylinders may be operated in another of the combustion modes. Further, during other conditions, an engine may utilize three or more different combustion modes among the various cylinders. As one example, a first bank of cylinders may be operated in HCCI mode while a second bank of cylinders may be operated in one of the SI modes. As yet another example, a first bank of the cylinders may be operated in one of the SI modes, while a first portion of the cylinders of a second bank are operated in HCCI mode and a second portion of cylinders of the second bank are deactivated.

In some embodiments, one or more cylinders of the engine may be controlled to vary operation between two or more combustion modes based on operating conditions of the engine. As one example, a first bank of cylinders may be operated in SI mode while a second bank of cylinders may be transitioned between an SI mode, HCCI mode and/or deactivation. Thus, it should be appreciated that other suitable modes of operation may be used among the various cylinders of the engine.

In this way, the engine may be controlled to vary the operating mode of some or all of the cylinders in numerous ways to achieve the benefits of each mode of operation. However, in some conditions, the transition of one or more cylinders between different modes of operation may cause torque transients due to one or more reasons.

As one example, torque transients may be caused by a transition of at least one cylinder of the engine between modes when the steady-state or average torque before and after the transition are not matched. For example, if the engine is not controlled during the transition between modes, a net increase or decrease in level of torque produced by the engine may occur. Therefore, in order to reduce the torque transients, one or more operating parameters of the engine may be adjusted in response to the transition in order to match the average torque produced by the engine before and after the transition.

As another example, torque transients may occur as a result of excitation of the driveline due to a transition of one or more cylinders between modes. For example, where a change in the torque pulsation characteristic occurs, a vibration mode of the driveline may be excited.

Figure 3:
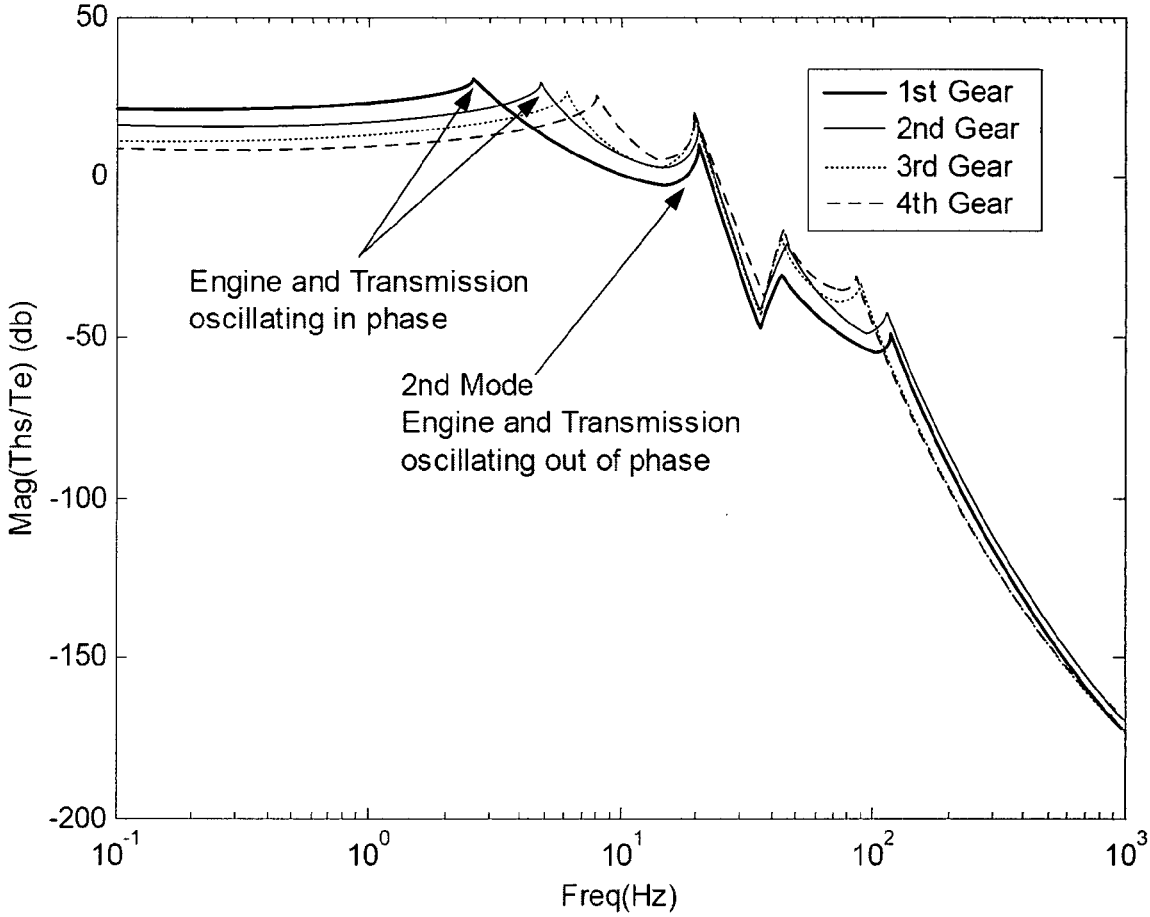
FIG. 3 is a graph illustrating sample vibration modes for an example vehicle driveline.

Referring now to FIG. 3, a graph illustrating sample vibration modes for an example vehicle driveline is shown. Specifically, the half shaft torque frequency response of a vehicle driveline with an automatic transmission is shown in FIG. 3 as a function of engine firing frequency. Note that firing frequency can be a function of the number of firing cylinders, the particular number of strokes utilized per cylinder, and the speed of the engine. The driveline vibration modes can be identified by an increase in magnitude as indicated, for example, by the arrows in FIG. 3. These modes may include:

- a shuffle mode, which may include the in phase oscillation of the engine and transmission inertias on the half shaft compliance;
- a second mode, which may include the out of phase oscillation of the engine and transmission inertias on the damper compliance; and
- higher frequency modes, which may be associated with the wheel inertia on the tire rotational compliance and the transmission input shaft compliance.

As one example, due to the sensitivity of the human body to longitudinal vibration, particularly in the range of 2 to 8 Hz, the vehicle operator and/or passengers may experience degraded drive feel if the lowest frequency driveline vibration mode (i.e. the shuffle mode) is excited.

Figure 4:
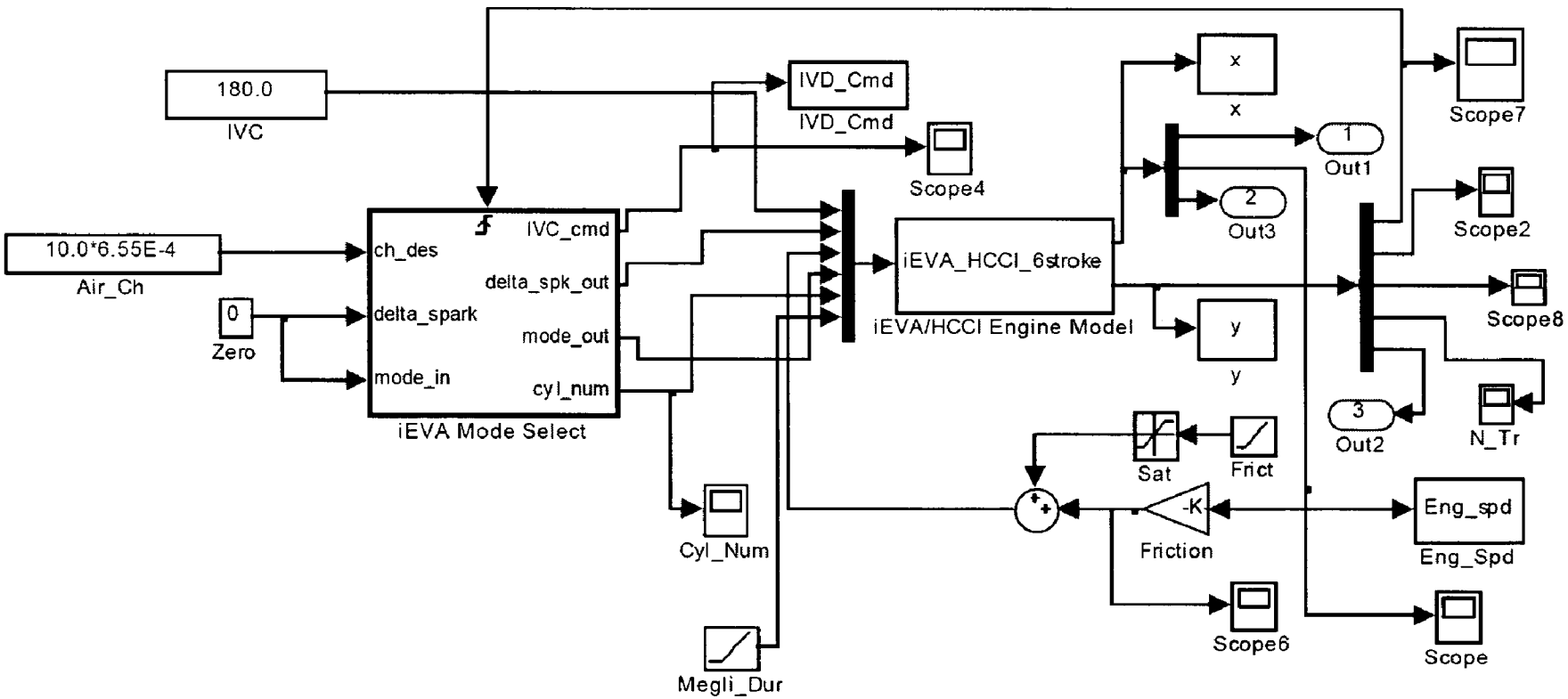
FIG. 4 schematically illustrates an example engine simulation.

FIG. 4 illustrates an example engine simulation that may be used to identify the driveline vibration modes illustrated in FIG. 3 and/or the torque output, for example, as illustrated in FIGS. 6-9 for various engine operating modes. For example, the engine simulation may be used to specify the number of firing cylinders of the engine, the engine speed, the combustion mode (e.g. HCCI, SI, etc.), the air/fuel ratio, the spark timing, valve timing, the fuel injection timing and amount, ambient conditions, transmission conditions, and other operating conditions of the engine. In this way, the engine, driveline and vehicle response may be predicted for various engine operating modes and transitions between these modes of operation.

To address some of the above issues, several approaches will be described for reducing the excitation of the driveline during a change in operating mode of the engine. While these approaches may include a method for reducing the particular excitation of the shuffle mode and the longitudinal acceleration during a mode transition, it should be appreciated that these approaches may be used to reduce excitation of other driveline frequencies.

In the various approaches described herein, an engine can be operated to provide pre and/or post mode transition engine torque modulation by adjusting the intake and/or exhaust valve timing (or exhaust cam phaser(s) in the case of iEVA), as well as the fuel, spark and/or transmission state. By controlling the valve timing in an EVA or iEVA engine it is possible to control the cylinder air charge and residual level as well as the start of combustion (SOC) timing (e.g. the 50% burn duration timing) and cylinder charge temperature for some combustion modes on an individual cylinder basis. Further, if at least some of the engine cylinders include direct injection, then the use of spark ignition of a stratified lean mixture or multi-stroke operation (e.g. six-stroke) among other modes of operation may be performed on a cylinder-by-cylinder basis. By controlling the EVA or iEVA valve timing, fuel and/or spark, the pre and post mode transition torque can be calibrated to reduce the transmission output peak-to-peak torque, reduce the variation in the vehicle longitudinal acceleration (e.g. maintain a vibration dose valve (VDV) of less than 0.5 during the transition), reduce the excitation of at least the lowest frequency driveline mode (e.g. the shuffle mode) or other frequencies, and/or provide a damping action to damp-out driveline modes that are excited.

Figure 5:
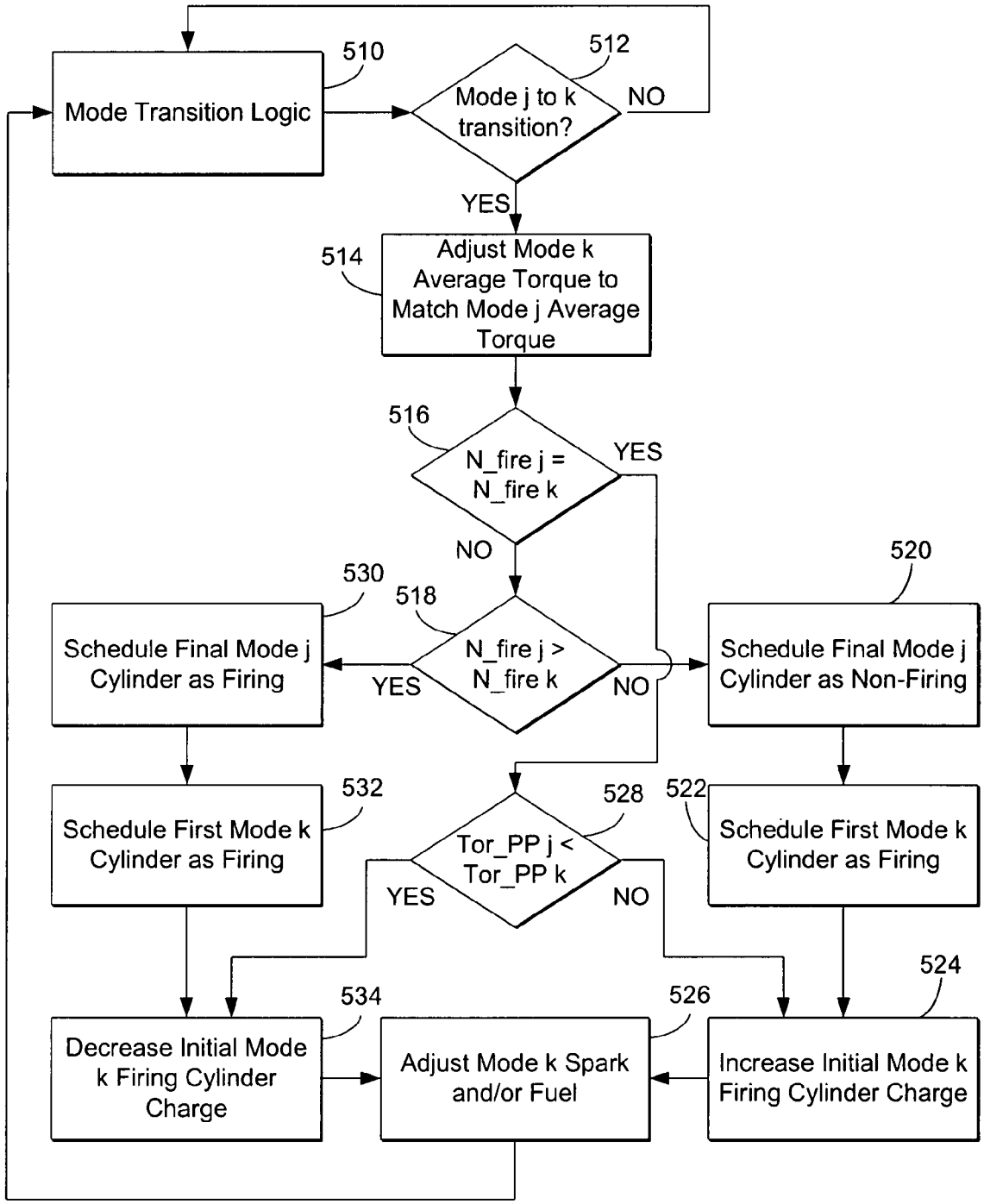
FIG. 5 is a flow chart illustrating an example routine that may be performed to control an engine transition.

Referring now to FIG. 5, a routine for controlling the output torque of an engine is described. Note that the various approaches described herein with reference to FIG. 5 may be facilitated by the engine control system including controller 12. As described above, for example, with reference to FIGS. 1 and 2, the engine can include intake EVA or intake and exhaust EVA and can be configured to operate between a SI mode including lean burn direct injection operation and HCCI mode, among other modes. Note that the terms "Mode j" and "Mode k" will be used to describe two different operating modes of the engine and may be used synonymously with the terms "first mode" and "second mode", respectively, as also may be used herein. For example, Mode j can be used to refer to a first mode of operation where HCCI is used to achieve combustion and Mode k can refer to a second mode of operation where SI is used, and vice-versa.

FIG. 5 illustrates the mode transition logic schematically at 510. The mode transition logic may be used, for example, by the engine control system to cause the engine or one or more cylinders of the engine to transition between two or more modes of operation in response to operating conditions of the engine or vehicle. At 512, it may be judged whether a transition from Mode j to Mode k is requested. For example, the control system may request a mode transition by application of the mode transition logic to the current or future predicted operating conditions of the engine or vehicle.

If the answer at 512 is no, the control system may continue to monitor the operating conditions to determine whether a transition is requested based on the mode transition logic. Alternatively, if the answer at 512 is yes, the average steady state engine output torque of Mode k may be matched to the average steady state output torque of Mode j at 514, for example, by adjusting the valve timing (e.g. via EVA), fuel (e.g. amount and/or timing), and/or spark timing, among other engine parameters. For example, the average steady state torque may be increased or decreased over one or more cycles after the transition to Mode k to more closely match the average steady state torque of Mode j. As another example, the average steady state torque of Mode j may be increased or decreased over one or more cycles before the transition to Mode k to more closely match the average steady state torque of Mode k. As yet another example, the average steady state torque of Mode j and Mode k may be adjusted accordingly so that they are more closely matched across the transition.

At 516 and 518 it may be judged whether the number of firing cylinders (i.e. N_fire) of the engine is increasing, decreasing, or remaining the same as the engine transitions from Mode j to Mode k. If it is judged at 516 that the number of firing cylinders for Modes j and k are the same across the transition, then the routine proceeds to 528. Alternatively, if the number of firing cylinders changes in response to the transition, then it may be judged whether the number of firing cylinders in Mode j is greater than the number of firing cylinders in Mode k at 518. In other words, it may be judged whether the number of firing cylinders is decreasing during the transition. For example, one or more cylinders of the engine may be deactivated, whereby combustion is discontinued in the cylinder for a prescribed period.

If it is judged at 518 that the number of firing cylinders in Mode k is to be greater than Mode j, then the answer at 518 is no. As such, the final cylinder of the Mode j operation may be scheduled to be a non-firing cylinder at 520 and the first cylinder of the Mode k operation may be scheduled to be a firing cylinder at 522. In this way, where the number firing cylinders is increasing in response to the transition, then at least the last cylinder in the first mode may not be fired and the first cylinder in the second mode may be fired. Further, the charge of at least the first firing cylinder of Mode k operation can be increased at 524, for example, by adjusting one or more of the valve timing and/or lift to increase air charge, spark timing may be advanced and/or the fuel pulse width may be increased to deliver additional fuel to the cylinder. In this way, the torque produced by at least the first cylinder in Mode k may be increased to more closely match the torque produced by the engine in Mode j. Thus, excitation of the driveline, particularly the shuffle mode may be reduced or cancelled. Thereafter, the charge may be decreased for one or more subsequent cylinders in Mode k. As the engine is transitioned to Mode k, the spark and/or fuel can be adjusted at 526 for the particular mode of operation as indicated by Mode k in order to control engine torque, whereby the routine returns to the mode transition logic at 510 as described above.

Returning to 518, if it is judged that the number of firing cylinders is decreasing from Mode j to Mode k, then the last cylinder of the Mode j operation may be scheduled as a firing cylinder at 530 and the first cylinder of the Mode k operation may be scheduled as a firing cylinder at 532. Further, the charge of at least the first firing cylinder of Mode k operation can be decreased at 534, for example, by adjusting one or more of the valve timing and/or lift to decrease air charge, spark timing may be retarded and/or the fuel pulse width may be decreased to deliver less fuel to the cylinder. Thereafter, the charge may be increased for one or more subsequent cylinders of Mode k. As the engine is transitioned to Mode k, the spark and/or fuel can be adjusted at 526 for the particular mode of operation as indicated by Mode k in order to control engine torque, whereby the routine returns to the mode transition logic at 510 as described above.

Returning to 516, if it is judged that the number of firing cylinders is to remain the same across the transition from Mode j to Mode k, then the routine may proceed to 528. At 528, it may be judged whether the peak to peak engine torque (i.e. Tor_PP) for Mode j is less than the peak to peak engine torque for Mode k. If the answer yes, then the routine may proceed to 534 where the charge of at least the first cylinder of Mode k may be decreased, thereby reducing the torque produced by the cylinder. Alternatively, if the answer at 528 is no, the routine may proceed to 524 where the charge of at least the first cylinder of Mode k may be increased, thereby increasing the torque produced by the cylinder. In this way, the torque produced by the engine for at least the first firing event of Mode k may be adjusted to more closely match the torque produced by the last cylinder of Mode j, thereby reducing excitation of the vehicle driveline and/or longitudinal acceleration caused by the transition.

Note that with regards to a transition involving a change in the number of strokes performed by one or more of the cylinders, the transition may be handled as either a change in peak to peak torque, for example, as indicated at 528 where the number of firing cylinders is not changing in response to the transition or where the number of firing cylinders is changing due to the transition, then the routine may proceed to 518. For example, where the engine is transitioning from a first mode where the cylinders are operated by HCCI with six strokes per cycle to a second mode where the cylinders are operated with four strokes per cycle, the charge of the first cylinder in the second mode may be increased (e.g. as indicated at 524) where the peak to peak torque is decreasing across the transition or the charge may be decreased (e.g. as indicated at 534) where the peak to peak torque is increasing across the transition. For example, where the number of strokes is increasing, the transition may be treated as a decrease in peak to peak torque, while during transitions where the number of strokes is decreasing, the transition may be treated as an increase in peak to peak torque, for example, as judged at 528. In this way, the approaches described above with reference to FIG. 5 may be used to reduce longitudinal acceleration and/or reduce excitation of the driveline where transitions between different multi-stroke operating modes are performed.

Referring now to FIGS. 6-15, graphs illustrating example transitions utilizing some or all of the approaches described above with reference to FIG. 5 are described. Each of the graphs in FIGS. 6-15 illustrates engine torque (as plotted along the vertical axis) across a range of engine rotational angle (as plotted along the horizontal axis). Note that in these examples, time increases in the same direction as with increasing rotational angle of the engine.

Figure 6:
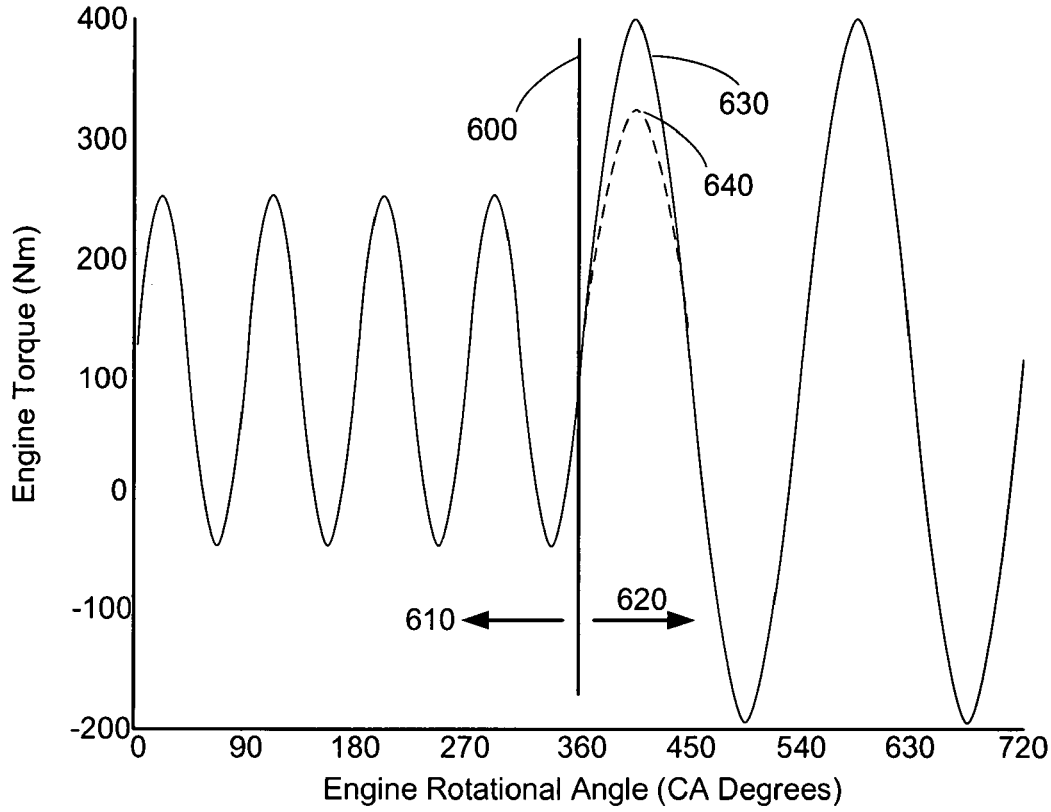
FIGS. 6-15 are graphs illustrating example torque control strategies.

FIG. 6 illustrates an example transition indicated at 600 from a first mode 610 to a second mode 620. The first mode 610 can include Mode j and the second mode 620 can include Mode k as described above with reference to FIG. 5. Thus, the first mode 610 and the second mode 620 can include various modes of operation. For example, the first mode 610 can include an operation where eight cylinders of the engine are operated via HCCI and the second mode 620 can include an operation where four cylinders of the engine are operated via SI or HCCI. In this way, FIG. 6 illustrates an example transition from a first mode where a greater number of cylinders are firing compared to the second mode, wherein the firing cylinders in the first mode produce a lower peak torque than the firing cylinders in the second mode. For example, the average torque produced by the engine in the second (at least near the transition region) can be controlled to more closely match the average torque produced by the engine in the first mode. Therefore, where the number of firing cylinders is less in the second mode than the first mode, the peak torque produced by the firing cylinders in the second mode may be greater than the peak torque produced by the firing cylinders in the first mode.

As the number of cylinders is decreasing across the transition, for example, as may be judged at 518 of FIG. 5, the charge of the first cylinder of the second mode may be decreased at 534, thereby reducing the torque produced by the cylinder. For example, as illustrated in FIG. 6, the torque may be decreased from 630 to 640 for the first firing event of the second mode, which utilizes four firing cylinders instead of the eight firing cylinders of the first mode.

Figure 7:
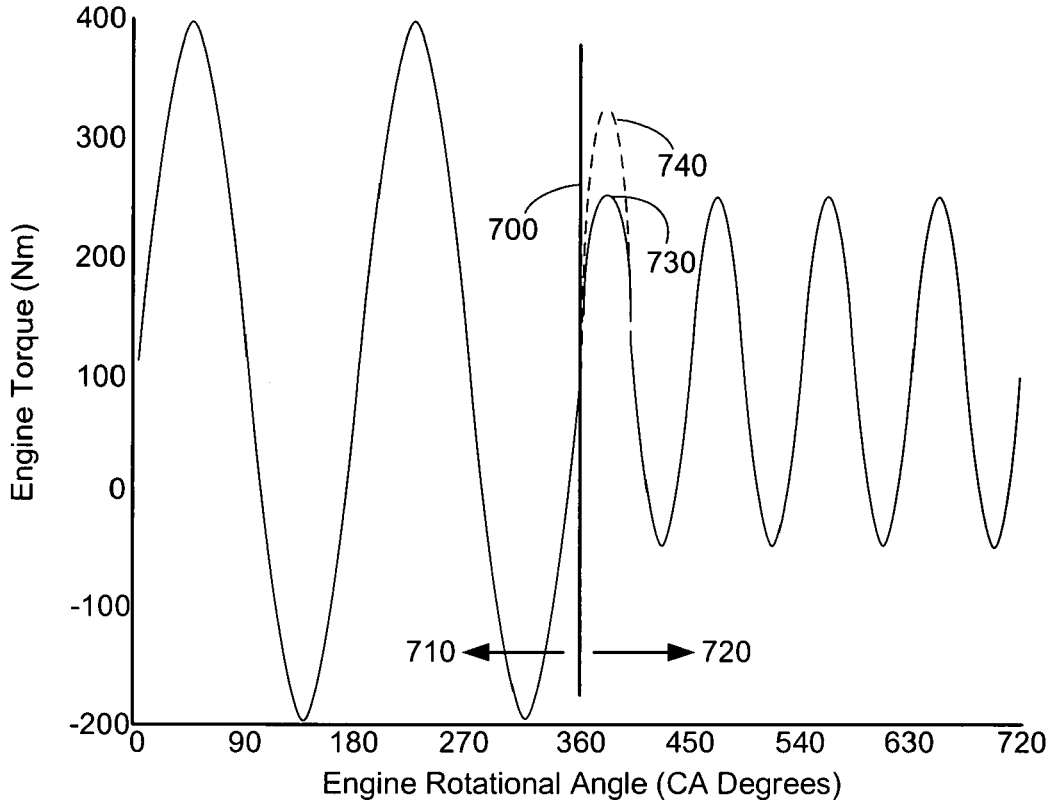

FIG. 7 illustrates an example transition in an opposite direction as described by FIG. 6. In particular, FIG. 7 illustrates a transition at 700 from a first mode 710 cylinders to second mode 720. Note that as one example, the first mode 710 can include operation of four firing cylinders in either by SI or HCCI and the second mode can include operation of eight firing cylinders in HCCI. As the number of firing cylinders is increasing in this particular example, the initial or first charge of the firing cylinder may be increased, for example, as described above with reference to 524 so that the engine torque output may be increased from 730 to 740 for at least the first firing event in the second mode.

In this way, by increasing or decreasing the amount of torque produced by the first firing cylinder in the second mode, the longitudinal acceleration and/or excitation of the driveline may be reduced.

Figure 8:
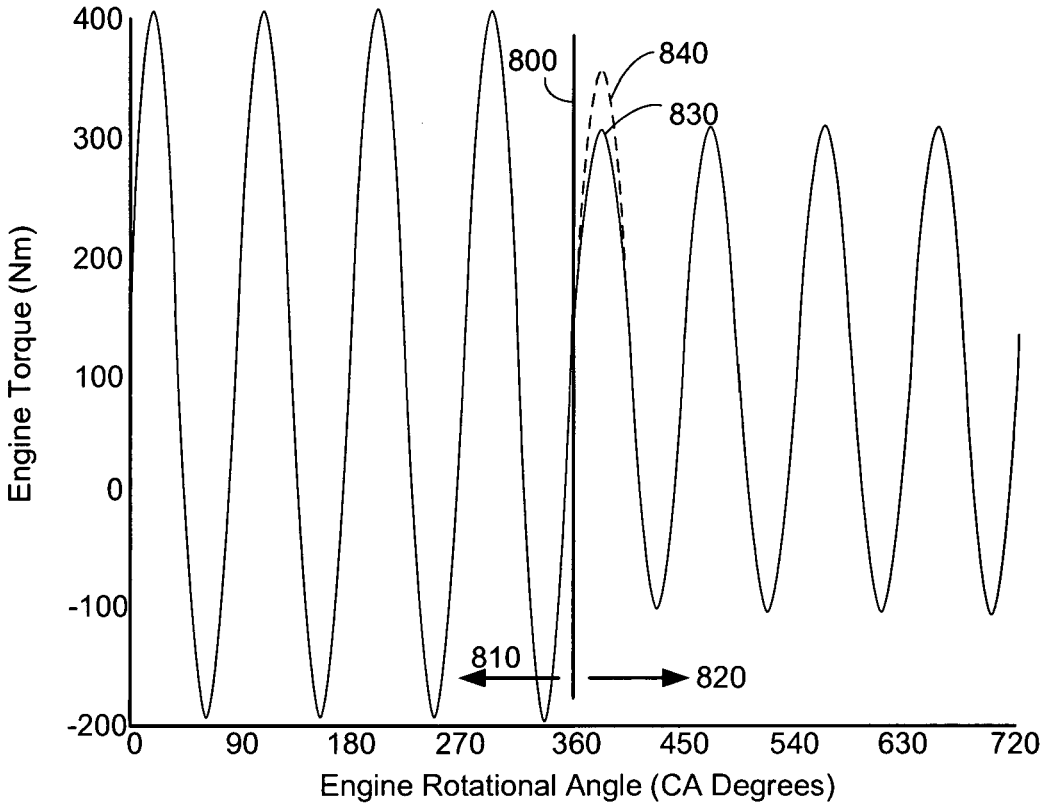

FIG. 8 illustrates a transition at 800 from a first mode 810 (e.g. having eight firing cylinders) to a second mode 820 having the same number of firing cylinders (e.g. also utilizing eight firing cylinders), whereby the torque produced by the firing cylinders in the second mode is less than the torque produced during the first mode. For example, the engine may be transitioned from a first mode utilizing HCCI for all eight firing cylinders to a second mode utilizing SI for all eight firing cylinders. While the number of firing cylinders is remaining constant in this particular example, the peak to peak torque between the first mode (e.g. utilizing HCCI) and the second mode (e.g. utilizing SI) is decreasing in response to the transition. Therefore, it may be judged (e.g. at 528 of FIG. 5) that the second mode peak to peak torque is not greater than the first mode peak to peak torque. As such, the torque produced by the first firing cylinder of the second mode may be increased from 830 to a higher torque indicated at 840.

Figure 9:
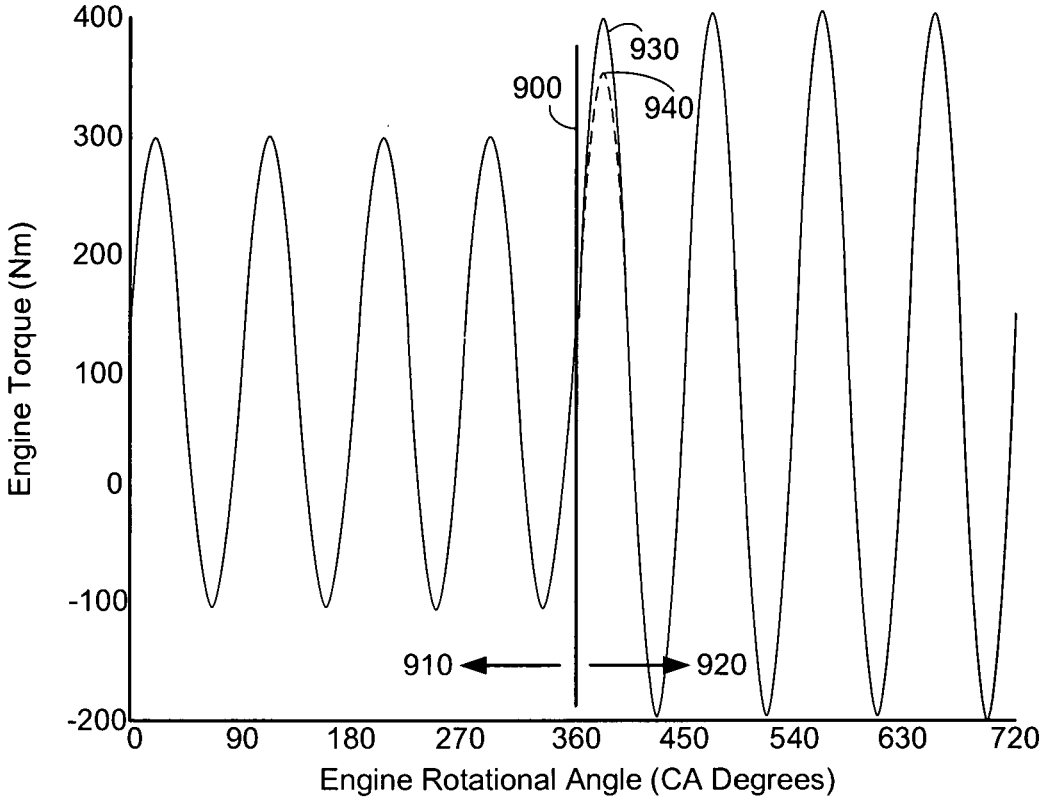

FIG. 9 illustrates a transition at 900 from a first mode 910 to a second mode 920. As one example, FIG. 9 illustrates a transition in the opposite direction illustrated by FIG. 8. For example, the engine may be transitioned from a first mode utilizing SI for all eight firing cylinders to a second mode utilizing HCCI for all eight firing cylinders. Further, the peak to peak torque of the second mode may be greater than the first mode in this example. As such, the torque produced by the first firing cylinder of the second mode may be decreased from 930 to 940, for example, as may be performed at 534 of FIG. 5.

Figure 10:
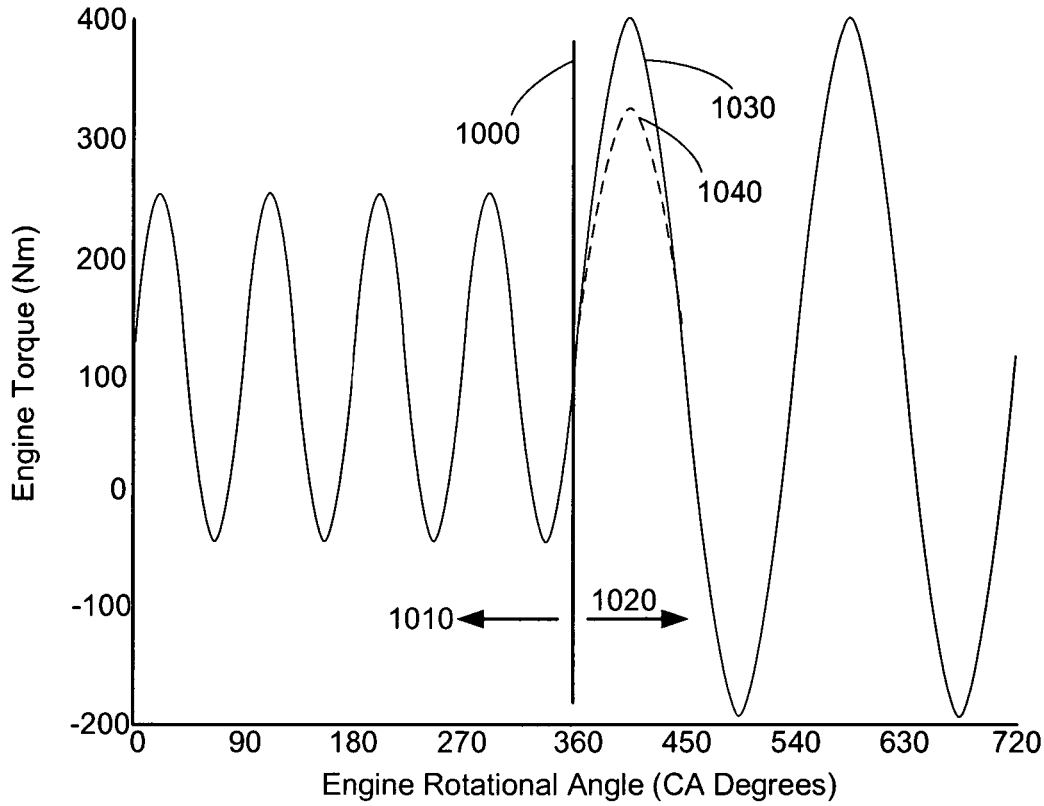

FIG. 10 illustrates a transition at 1000 from a first mode 1010 to a second mode 1020. As one example, the first mode 1010 may include operation of the firing cylinders in a four stroke per cycle mode while the second mode includes operation of the firing cylinders in a 6 stroke per cycle mode. Thus, the frequency of combustion events in the second mode may be less than the frequency in the first mode. As such, the torque produced by the firing cylinders in the second mode may be greater than the firing cylinders of the first mode if an average torque is to be maintained across transition 1000. In this example, the torque produced by the first firing cylinder of the second mode may be reduced for the first firing event from 1030 to 1040 in order to reduce torque transients that may otherwise occur between the torque produced by the first mode and the second mode.

Figure 11:
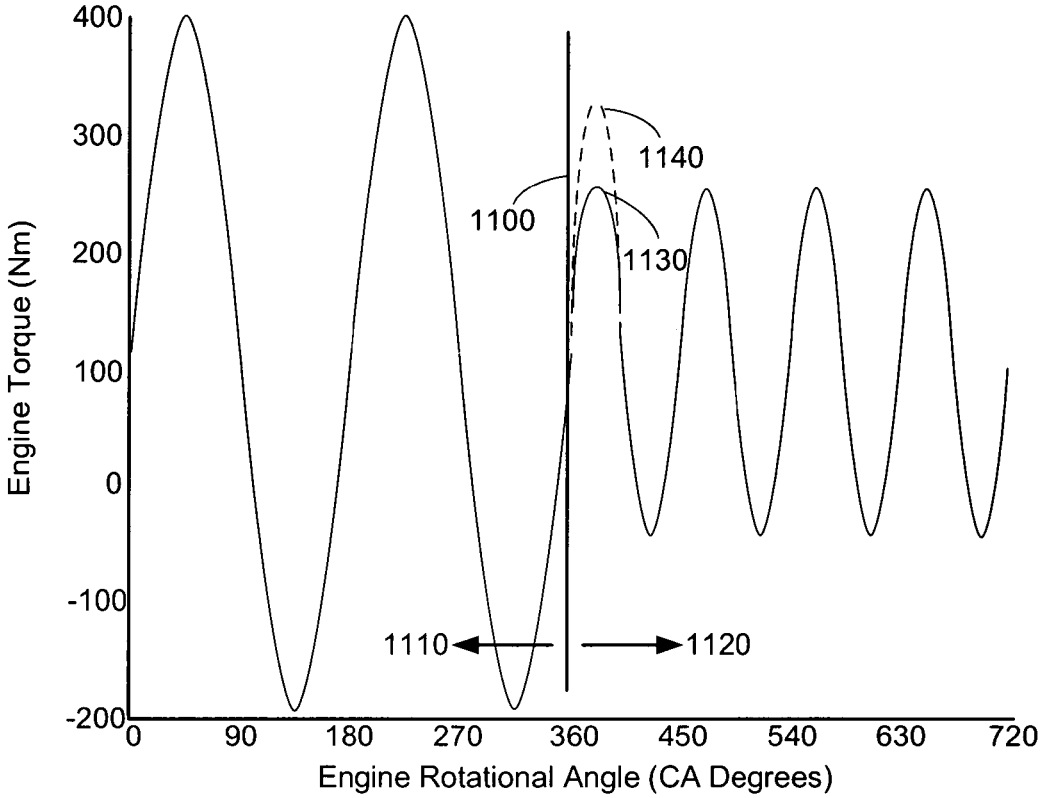

FIG. 11 illustrates a transition at 1100 from a first mode 1110 to a second mode 1120. As one example, FIG. 11 illustrates a transition in the opposite direction illustrated by FIG. 10 where the number of strokes per cycle may be increasing from the first mode to the second mode. In particular, the peak to peak torque of the second mode is less than the first mode in this example. As such, the torque produced by the first firing cylinder of the second mode may be temporarily increased from 1130 to 1140 for at least one cycle.

As described above with reference to FIGS. 6-11, the torque produced by the first firing cylinder of the second mode may be increased or decreased in response to the amount of torque produced by the previous firing cylinder in the first mode and/or the subsequent firing cylinder in the second mode. For example, the torque produced by the first firing cylinder of the second mode may be controlled to be between (i.e. within the range of) the torque produced by the previous and subsequent firing cylinders. In this way, the rate of change in torque across the transition between the two modes may be reduced or smoothed, thereby reducing longitudinal acceleration of the vehicle and/or reducing excitation of the driveline.

Further, it should be appreciated that the torque produced by the second and/or subsequent firing cylinders of the second mode may also be increased or decreased to reduce the rate of change in the torque produced by the engine resulting from a transition. For example, the torque produced by a second firing cylinder of the second mode may be controlled to be between the torque or within the range of torque produced by the previous (i.e. first firing cylinder) and subsequent (i.e. third firing cylinder) of the second mode.

Figure 12:
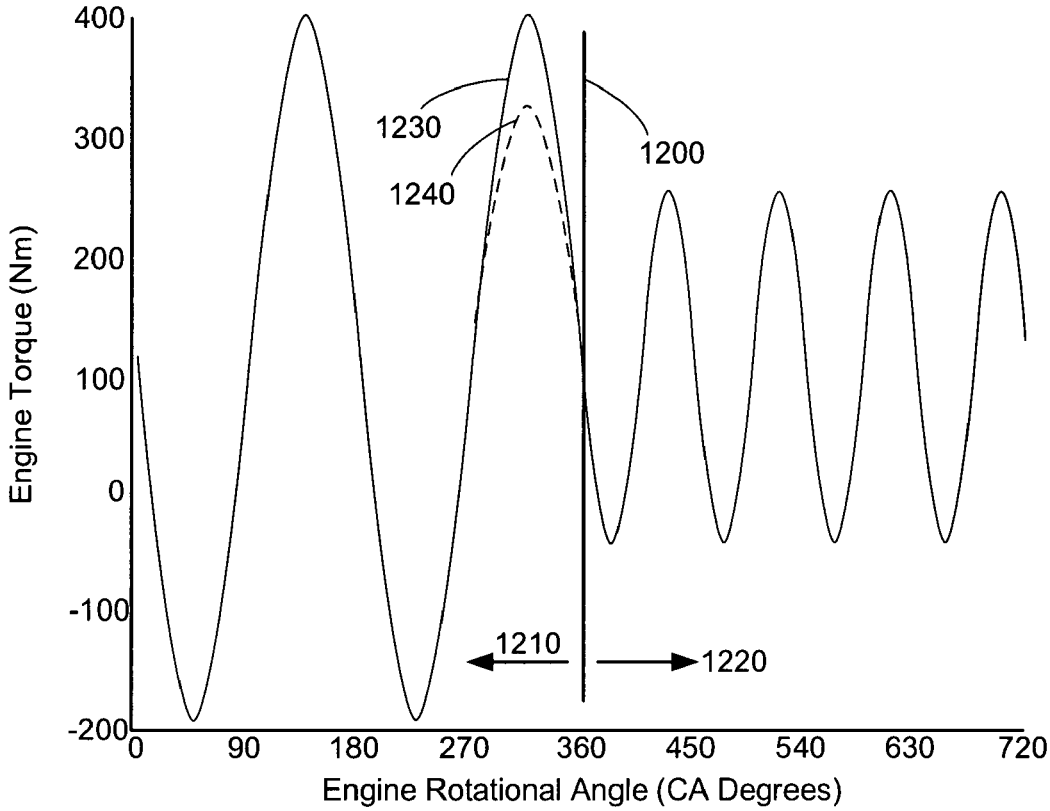
Figure 13:
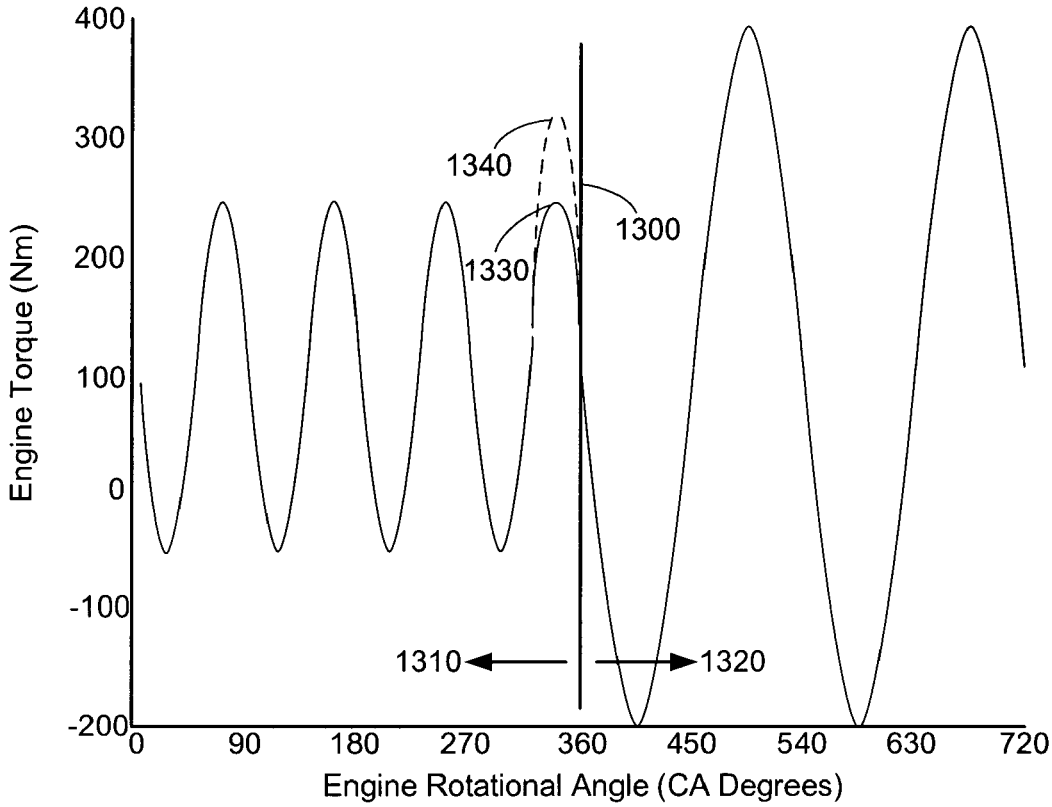

In addition to or as an alternative to the adjustment of the torque produced by the first and/or subsequent firing cylinders of the second mode, the last firing cylinder of the first mode may be adjusted to reduce the torque transients caused by the transition. FIGS. 12 and 13, for example, illustrate transitions where the torque produced by the last firing cylinder of the first mode is adjusted.

In particular, FIG. 12 illustrates a transition at 1200 between a first mode 1210 and a second mode 1220 whereby the torque produced by the last firing cylinder of the first mode is reduced from 1230 to 1240. For example, the torque produced by the last firing cylinder of the first mode may be temporarily adjusted to be between the previous firing cylinder having a higher peak torque and the subsequent firing cylinder having a lower peak torque in order to reduce or smooth torque transients through the transition.

Similarly, FIG. 13 illustrates a transition at 1300 between a first mode 1310 and a second mode 1320 whereby the torque produced by the last firing cylinder of the first mode is temporarily increased from 1330 to 1340 for at least one cycle in response to the increase in torque between the first and the second modes.

Figure 14:
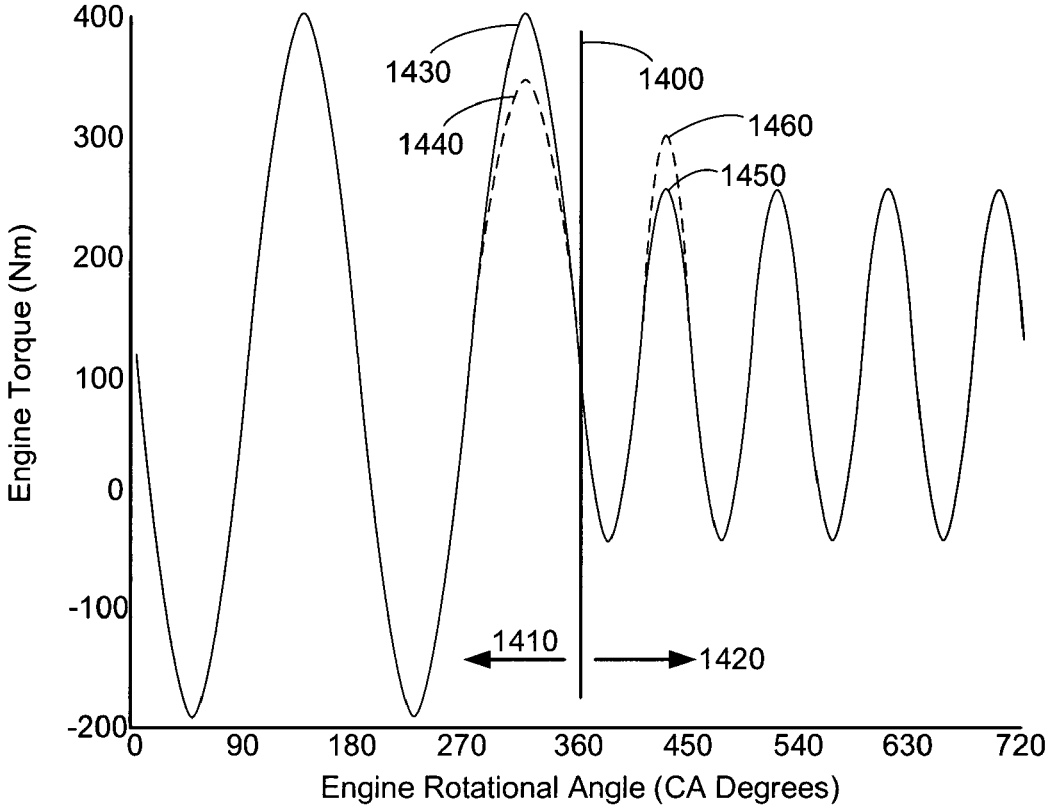

FIG. 14 illustrates a transition 1400 between a first mode 1410 and a second mode 1420 whereby the torque produced by the last firing cylinder of the first mode and the first firing cylinder of the second mode are adjusted. For example, torque produced by the last firing cylinder of the first mode may be reduced from 1430 to 1440 while the first firing cylinder of the second mode may be increased from 1450 to 1460. Further, more cylinders in the first and/or second modes may be temporarily adjusted, for example, as illustrated by FIG. 15.

Figure 15:
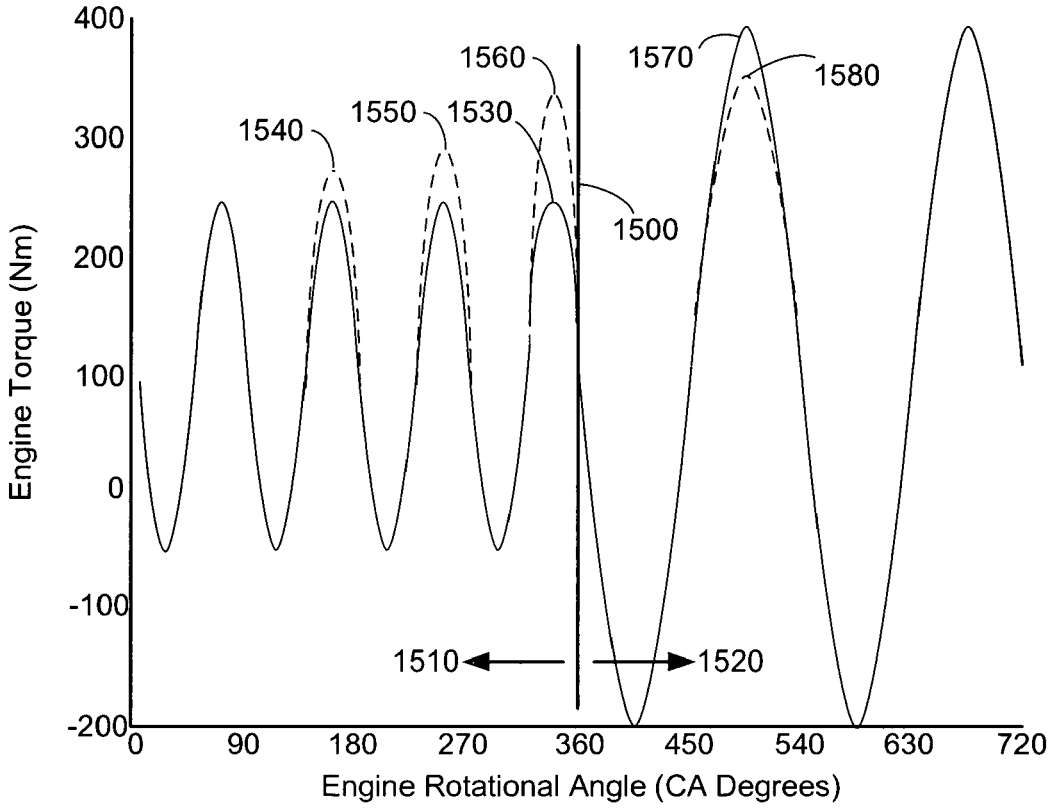

FIG. 15 illustrates a transition 1500 between a first mode 1510 and a second mode 1520 whereby the torque produced by a plurality of firing cylinders are temporarily adjusted for their last firing events of the mode while the torque produced by a first firing cylinder of the second mode is also adjusted to reduce the torque transient between the first mode and the second mode. For example, the torque produced by the last three firing cylinders of the first mode may be increased from 1530 to 1540, 1550, and 1560, respectively while the amount of torque produced by the first firing cylinder of the second may be reduced from 1570 to 1580. Note that the torque produced by more or less cylinders may be adjusted in the first and/or second modes to reduce torque transients between the two modes.

In some embodiments, the various approaches described above with reference to FIGS. 5-15 may be used with increased transmission slip to further reduce longitudinal acceleration and/or excitation of the driveline that may result from a transition between operating modes. As one example, an amount of slip performed by one or more of the transmission clutches may be increased, thereby adjusting the average torque that is delivered to a drive wheel of the vehicle via the driveline, while also damping torque transients that may occur in response to the transition. However, use of transmission clutch slip may increase fuel consumption, under some conditions, thereby reducing fuel efficiency. In particular, during conditions where the number of mode transitions may be higher, such as during stop and go, or city driving, the inefficiency associated with this approach may be increased. As such, the use of increased clutch slip may be selectively used where active modulation of the engine torque has not sufficiently reduced the torque transients during the transition or where the various control parameters of the engine have reached limits where additional adjustment of the cylinder torque is difficult.

Figure 16:
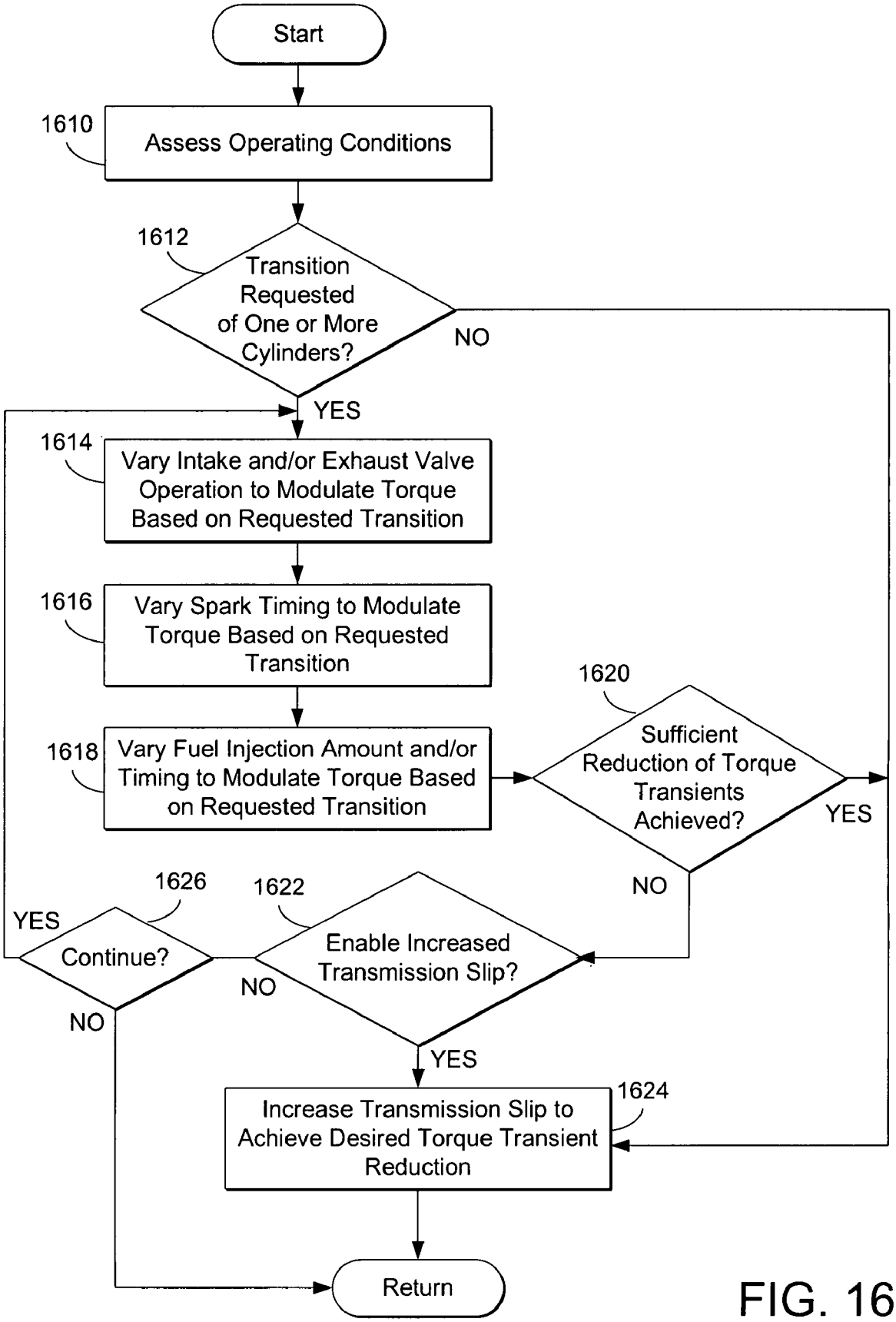
FIG. 16 is a flow chart illustrating an example routine that may be performed to control an engine transition including the selective use of transmission slip.

FIG. 16 provides an example control routine that may be performed in response to a transition to reduce torque transients. Note that the approaches described with reference to FIG. 16 may used in addition or as an alternative to the approaches described above with reference to FIG. 5 to improve drivability of a vehicle that utilizes engine mode transitions. At 1610, the control system may assess operating conditions including past conditions, present conditions, and predicted future operating conditions of the engine and/or driveline including the transmission. Operating conditions may include, the mode and firing condition of each of the cylinders, transmission conditions, driver requested torque and speed, ambient conditions such as air temperature and pressure, valve timing, spark timing, fuel injection amount and timing, turbocharging or supercharging conditions, emission control device conditions, among others. As one example, the state of the transmission may be assessed including the gear selected and/or the amount of slip provided by one or more of the transmission clutches.

At 1612, it may be judged whether a transition is requested of one or more cylinders. If the answer is no, then the routine may return to 1610. Alternatively, if the answer at 1612 is yes, then the control system may vary operation (e.g. timing, lift, etc.) of one or more of the intake and/or exhaust valves at 1614, the spark timing at 1616, and/or the fuel injection amount and/or timing at 1618 to modulate torque based on the requested transition. As described above, the modulation of torque may be performed prior to the transition, during the transition, and/or after the transition to achieve a reduction in the torque transients. Note that valve operation may be varied by varying the valve timing, valve lift, and/or valve lift duration via the EVA system or by cam actuation for the exhaust valves in the case of an iEVA configuration. As one example, the torque may be temporarily adjusted or modulated so that the peak torque produced by each firing cylinder is more closely matched between the previous firing cylinder and the subsequent firing cylinder. Note that the amount of the temporary adjustment may be based on the difference between the peak amount of torque produced by the immediately previous firing cylinder and the immediately subsequent firing cylinder. As yet another example, the amount of the temporary adjustment may be based on the transmission state including the selected gear and/or transmission slip. For example, the amount of the temporary adjustment of peak torque may be increased or decreased with increasing transmission slip and/or gear ratio depending on the direction and/or type of transition to reduce longitudinal acceleration of the vehicle and/or to avoid the various natural frequencies of the transmission as illustrated in FIG. 3.

Note that the engine torque may be modulated differently depending on the particular operating mode of the cylinder and/or engine. As one example, where a cylinder of the engine is transitioned from an SI mode of operation to HCCI mode, spark timing control may be used to modulate or temporarily adjust torque before the transition while operating in SI mode and the use of fueling control (e.g. fuel amount and/or timing of deliver) may be used to modulate torque after the transition when operating in HCCI mode. For example, some operating parameters may not be available for adjustment in some modes, such as the use of spark timing during HCCI mode where the use of spark has been discontinued. In this way, a suitable engine parameter may be adjusted for the particular operating mode of the cylinder. In other words, some control parameters may not cause a modulation of torque during some modes or may be more or less sensitive than desired. Further still, the use of some control parameters during some modes may be more prone to misfire, noise and vibration harshness, etc. and may therefore be avoided or may be used to a lesser extent.

While torque may be modulated by adjusting one or more parameters that are suitable for the particular operating mode, torque may be increased or decreased differently depending on the type of adjustment. As one example, the torque produced by the engine may be reduced, during some conditions (e.g. SI mode), by further retarding the spark timing of one or more cylinders of the engine. Conversely, engine torque may be increased by advancing the spark timing, under some condition. As another example, charge temperature may be controlled by varying the amount of exhaust gases that are trapped within the cylinder from a previous cycle or the amount of EGR supplied to the cylinder. Charge temperature may be used to vary torque by increasing or decreasing the expansion performed by the ignited gas and/or may be used to vary the timing of combustion in some modes, such as HCCI. As yet another example, fuel injection amount and/or timing can be used to vary the air/fuel ratio and the homogeneity of the mixture, thereby further varying the torque produced by the engine.

At 1620, it may be judged whether a sufficient reduction of torque the transients across the transition have been achieved. If the answer is yes, then the routine may return to 1610. Alternatively, if the answer at 1620 is no, it may be judged whether to enable increased transmission slip at 1622. As one example, increased transmission slip may be used where the torque transients across the transition are greater than a threshold. As another example, transmission slip may be used where one or more control parameters (e.g. 1614-1618) of the engine are at or near a limit. For example, the spark timing may be retarded only to a point where unstable combustion may occur, or fuel injection amount may be increased only to a certain extent. Further still, transmission slip may be avoided or reduced where fuel efficiency is desired as the use of transmission slip may serve to increase fuel consumption of the engine. In this way, transmission slip may be used to achieve reduced longitudinal acceleration and/or reduced excitation of the driveline under some conditions. Note that transmission slip may refer to slip provided by one or more clutches throughout the driveline between the engine and the drive wheel of the vehicle.

If the answer at 1622 is no, it may be judged at 1626 whether to continue to reduce torque transients via one or more operations described above with reference to 1614, 1616, and 1618. If the answer at 1626 is yes, one or more of 1614, 1616, and 1618 may be further adjusted to achieve the desired reduction of torque transients. Alternatively, if the answer at 1616 is no, the routine may return.

Alternatively, if the answer at 1622 is yes, a level of slip provided by one or more transmission clutches may be increased to achieve the desired torque transient reduction. In some conditions, the amount of slip may be based on the selected gear of the transmission or gear ratio. For example, when the transmission is set to a lower gear ratio, the amount of slip may be greater than when the transmission is set to a higher gear ratio in order to achieve a similar level of damping. Further still, excitation of the vehicle driveline may depend on the gear ratio of the transmission. As such, the extent to which operating conditions are varied in 1614, 1616, and 1618 may be based on the gear ratio of the transmission during the transition between combustion modes.

In some embodiments, the control system may vary the gear ratio of the transmission before, during, and/or after a transition of one or more cylinders between combustion modes in order to reduce excitation of the drive line. For example, a change in gear ratio may be performed with or without a corresponding increase in transmission slip, thereby enabling a reduction in torque transients caused by mode transitions. Finally, the routine may return to 1610 where operating conditions may be monitored for future transitions.

Figure 17:
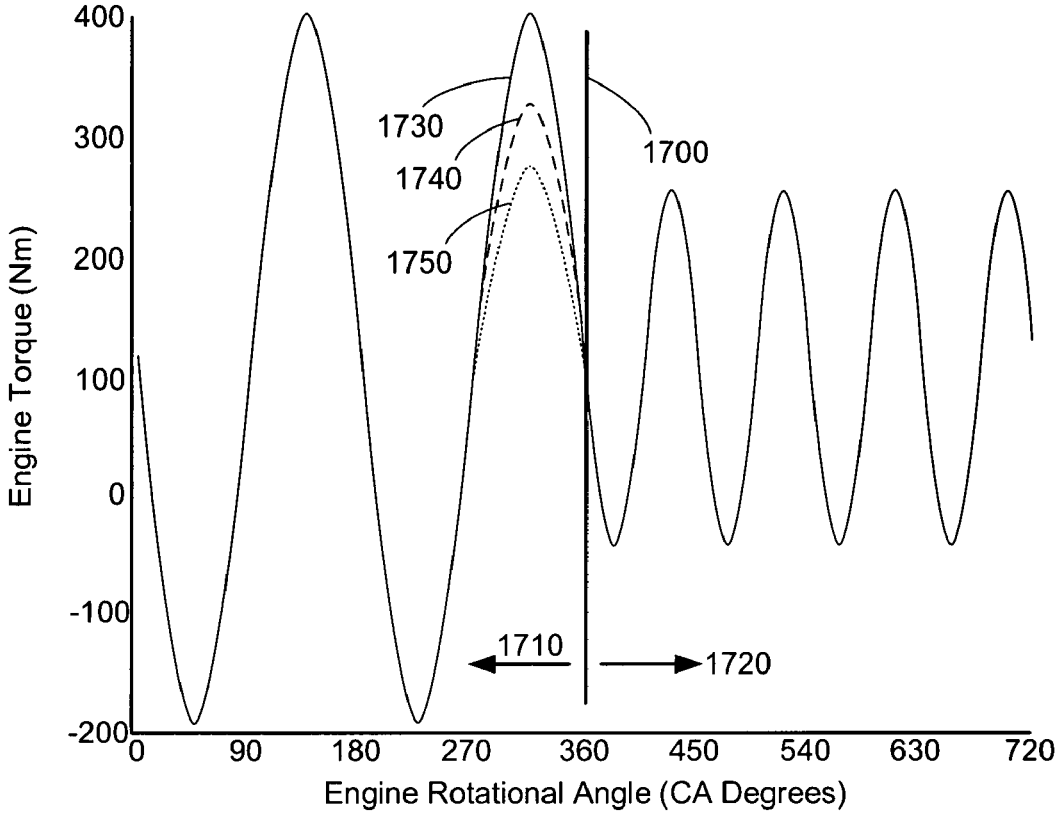
FIGS. 17 and 18 are graphs illustrating example torque control strategies.

FIG. 17 illustrates a transition 1700 between a first mode 1710 and a second mode 1720 whereby the torque produced by a cylinder may be adjusted responsive to a state of the transmission (e.g. the amount of clutch slip and/or selected gear or gear ratio) to reduce excitation of the driveline. For example, the torque produced by the last firing cylinder of the first mode may be adjusted from 1730 to 1740 in response to a first transmission state and may be adjusted from 1730 to 1750 in response to a second transmission state different from the first transmission state.

Figure 18:
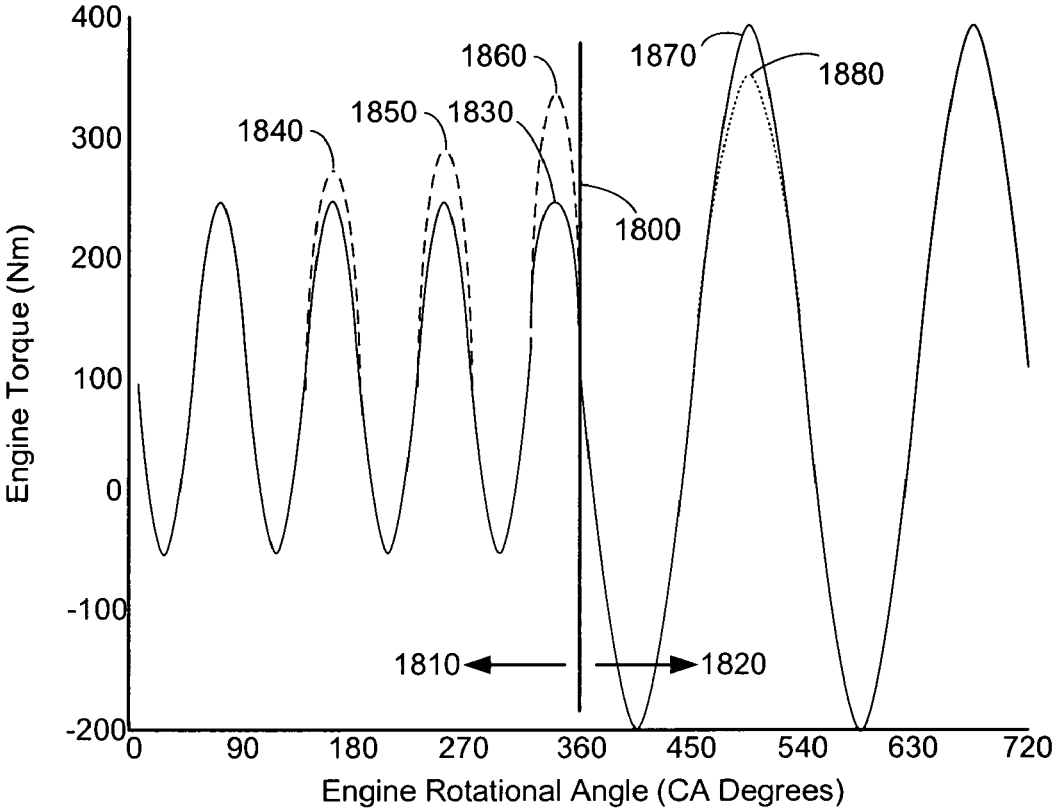

FIG. 18 illustrates a transition 1800 between a first mode 1810 and a second mode 1820 whereby the particular torque modulation strategy performed in response to the transition may be selected differently depending on the transmission state. As one example, during a first transmission state, the torque produced by a first quantity of firing cylinders may be adjusted, for example, from 1830 to 1840, 1850, and 1860, respectively, while during a second transmission state, the torque produced by a second quantity of firing cylinders may be adjusted, for example, from 1870 to 1880. In this way, transitions may be facilitated by different temporary torque modulations in response to transmission state.

Note that the example control and estimation routines included herein can be used with various engine and/or vehicle system configurations. The specific routines described herein may represent one or more processing strategies such as event-driven, interrupt-driven, multi-tasking, multi-threading, and the like. As such, various steps, operations, or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated steps or functions may be repeatedly performed depending on the particular strategy being used. Further, the described steps may graphically represent code to be programmed into the computer readable storage medium in the engine control system.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and nonobvious combinations and subcombinations of the various systems and configurations, and other features, functions, and/or properties disclosed herein.

The following claims particularly point out certain combinations and subcombinations regarded as novel and nonobvious. These claims may refer to "an" element or "a first" element or the equivalent thereof. Such claims should be understood to include incorporation of one or more such elements, neither requiring nor excluding two or more such elements. Other combinations and subcombinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A method of operating an engine having a plurality of cylinders, the method comprising:

transitioning the engine from a first mode to a second mode;

temporarily adjusting an amount of torque produced by a cylinder of the engine for at least one cycle responsive to a difference in an amount of torque produced by a previous firing cylinder and a subsequent firing cylinder;

firing a final first mode cylinder if a number of cylinders firing increases from the first mode to the second mode during the transition; and inhibiting the final first mode cylinder from firing if the number of cylinders firing decreases from the first mode to the second mode during the transition.

2. The method of claim 1, wherein a first cylinder of the second mode is scheduled to fire whether the number of firing cylinders increases or decreases from the first mode to the second mode.

3. The method of claim 2, wherein an initial cylinder charge of the second mode is decreased if the number of firing cylinders increases from the first mode to the second mode.

4. The method of claim 2, wherein an initial cylinder charge of the second mode is increased if the number of firing cylinders decreases from the first mode to the second mode.

5. The method of claim 1, further comprising decreasing an initial second mode cylinder charge if a number of firing cylinders is the same between the first mode and the second mode and if a peak torque of the first mode is less than a peak torque of the second mode.

6. The method of claim 1, further comprising increasing an initial second mode cylinder charge if a number of firing cylinders is the same between the first mode and the second mode and if a peak torque of the first mode is greater than a peak torque of the second mode.

7. The method of claim 1, wherein the first mode includes combustion performed by spark ignition and the second mode includes combustion performed by compression ignition.

8. The method of claim 1, wherein the first mode includes operating with a first number of strokes per cycle and the second mode includes operating with a second number of strokes per cycle different from the first number.

9. The method of claim 1, further comprising, increasing an amount of slip in a clutch of a transmission in response to a mode change from the first mode to the second mode.

10. The method of claim 1, wherein the first mode includes at least the cylinder performing homogeneous charge compression ignition with a six stroke cycle and the second mode includes the cylinder performing spark ignition with a four stroke cycle.

11. A method of operating an engine having a plurality of cylinders, the method comprising:

transitioning at least one cylinder of the engine from a first mode to a second mode; and temporarily adjusting a peak amount of torque produced by a last firing cylinder of the first mode and a first firing cylinder of the second mode, for at least one cycle, and responsive to a difference between a number of strokes per cycle of said at least one cylinder in the first mode and a number of strokes per cycle of said at least one cylinder in the second mode.

12. The method of claim 11, further comprising scheduling a last cylinder of the first mode as a non-firing cylinder and scheduling a first firing cylinder of the second mode as a firing cylinder when the first quantity of firing cylinders in the first mode is less than the second quantity of firing cylinders in the second mode.

13. The method of claim 11, further comprising scheduling a last firing cylinder of the first mode as a firing cylinder and scheduling a first firing cylinder of the second mode as a firing cylinder when the first quantity of firing cylinders in the first mode is greater than the second quantity of firing cylinders in the second mode.

14. The method of claim 11, wherein the peak amount of torque is temporarily adjusted to be between the peak amount of torque produced by a previous firing cylinder in the first mode and a subsequent firing cylinder in the second mode; and wherein the peak amount of torque produced by the cylinder is subsequently adjusted after said temporary adjustment to be substantially equal to a peak amount of torque produced by the other firing cylinders of the engine.

* * * * *